US009556504B2

(12) United States Patent
Na et al.

(10) Patent No.: US 9,556,504 B2
(45) Date of Patent: Jan. 31, 2017

(54) BULK NICKEL-PHOSPHORUS-BORON GLASSES BEARING CHROMIUM AND TANTALUM

(71) Applicant: Glassimetal Technology, Inc., Pasadena, CA (US)

(72) Inventors: Jong Hyun Na, Pasadena, CA (US); Michael Floyd, Pasadena, CA (US); Marios D. Demetriou, West Hollywood, CA (US); William L. Johnson, San Marino, CA (US); Glenn Garrett, Pasadena, CA (US)

(73) Assignee: Glassimetal Technology, Inc., Pasadena, CA (US)

( * ) Notice: Subject to any disclaimer, the term of this patent is extended or adjusted under 35 U.S.C. 154(b) by 492 days.

(21) Appl. No.: 14/081,622

(22) Filed: Nov. 15, 2013

(65) Prior Publication Data

US 2014/0130945 A1 May 15, 2014

Related U.S. Application Data

(60) Provisional application No. 61/726,740, filed on Nov. 15, 2012.

(51) Int. Cl.

| | |
|---|---|
| ***C22C 45/04*** | (2006.01) |
| ***C22C 1/00*** | (2006.01) |
| ***C22C 19/05*** | (2006.01) |

(52) U.S. Cl.

CPC ..... *C22C 45/04* (2013.01); *C22C 1/002* (2013.01); *C22C 19/05* (2013.01); *C22C 19/058* (2013.01)

(58) Field of Classification Search

None

See application file for complete search history.

(56) References Cited

U.S. PATENT DOCUMENTS

| | | | |
|---|---|---|---|
| 3,856,513 | A | 12/1974 | Chen et al. |
| 4,116,682 | A | 9/1978 | Polk et al. |
| 4,126,284 | A | 11/1978 | Ichikawa et al. |
| 4,144,058 | A | 3/1979 | Chen et al. |
| 4,152,144 | A | 5/1979 | Hasegawa et al. |
| 4,385,932 | A | 5/1983 | Inomata et al. |
| 4,582,536 | A | 4/1986 | Raybould |
| 4,892,628 | A | 1/1990 | Guilinger |

(Continued)

FOREIGN PATENT DOCUMENTS

| | | |
|---|---|---|
| CN | 1354274 | 6/2002 |
| CN | 1653200 | 8/2005 |

(Continued)

OTHER PUBLICATIONS

U.S. Appl. No. 14/029,719, filed Sep. 17, 2013, Na et al.
U.S. Appl. No. 14/048,894, filed Oct. 8, 2013, Na et al.
U.S. Appl. No. 14/067,521, filed Oct. 30, 2013, Na et al.
U.S. Appl. No. 14/077,830, filed Nov. 12, 2013, Na et al.
U.S. Appl. No. 14/149,035, filed Jan. 7, 2014, Na et al.

(Continued)

*Primary Examiner* — George Wyszomierski
(74) *Attorney, Agent, or Firm* — Polsinelli PC

(57) ABSTRACT

A bulk-glass forming Ni—Cr—Nb—P—B alloy is provided. The alloy includes $Ni_{(100-a-b-c-d)}Cr_aTa_bP_cB_d$, where the atomic percent a is between 3 and 11, the atomic percent b is between 1.75 and 4, the atomic percent c is between 14 and 17.5, and the atomic percent d is between 2.5 and 5. The alloy is capable of forming a metallic glass having a lateral dimension of at least 3 mm.

20 Claims, 12 Drawing Sheets

(56) References Cited

U.S. PATENT DOCUMENTS

| | | | | |
|---|---|---|---|---|
| 4,900,638 | A | 2/1990 | Emmerich | |
| 4,968,363 | A | 11/1990 | Hashimoto et al. | |
| 5,338,376 | A | 8/1994 | Liu et al. | |
| 5,429,725 | A | 7/1995 | Thorpe et al. | |
| 5,634,989 | A | 6/1997 | Hashimoto et al. | |
| 6,004,661 | A | 12/1999 | Sakai et al. | |
| 6,303,015 | B1 | 10/2001 | Thorpe et al. | |
| 6,325,868 | B1 | 12/2001 | Kim et al. | |
| 6,695,936 | B2 | 2/2004 | Johnson | |
| 8,287,664 | B2 | 10/2012 | Brunner | |
| 9,085,814 | B2 * | 7/2015 | Na | C22C 1/002 |
| 2005/0263216 | A1 | 12/2005 | Chin et al. | |
| 2006/0213586 | A1 | 9/2006 | Kui | |
| 2007/0175545 | A1 | 8/2007 | Urata et al. | |
| 2009/0110955 | A1 | 4/2009 | Hartmann et al. | |
| 2012/0073710 | A1 | 3/2012 | Kim et al. | |
| 2012/0168037 | A1 | 7/2012 | Demetriou et al. | |
| 2013/0048152 | A1 | 2/2013 | Na et al. | |
| 2014/0213384 | A1 * | 7/2014 | Johnson | A63B 53/00 473/282 |
| 2014/0238551 | A1 | 8/2014 | Na et al. | |
| 2015/0047755 | A1 | 2/2015 | Na et al. | |
| 2015/0158126 | A1 * | 6/2015 | Hartmann | B23K 35/0233 403/272 |
| 2015/0159242 | A1 | 6/2015 | Na et al. | |
| 2015/0176111 | A1 | 6/2015 | Na et al. | |
| 2015/0240336 | A1 | 8/2015 | Na et al. | |

FOREIGN PATENT DOCUMENTS

| | | |
|---|---|---|
| DE | 3929222 | 3/1991 |
| DE | 102011001783 | 10/2012 |
| DE | 102011001784 | 10/2012 |
| EP | 0014335 | 8/1980 |
| EP | 0161393 | 11/1985 |
| EP | 0260706 | 3/1988 |
| EP | 1077272 | 2/2001 |
| EP | 1108796 | 6/2001 |
| EP | 1522602 | 4/2005 |
| JP | 54-76423 | 6/1979 |
| JP | S55-148752 | 11/1980 |
| JP | S57-13146 | 1/1982 |
| JP | 63-079930 | 4/1988 |
| JP | 63079931 | 4/1988 |
| JP | 63-277734 | 11/1988 |
| JP | 1-205062 | 8/1989 |
| JP | 08-269647 | 10/1996 |
| JP | 11-71659 | 3/1999 |
| JP | 2001-049407 | 2/2001 |
| JP | 2007-075867 | 3/2007 |
| WO | WO 2012/053570 | 4/2012 |
| WO | WO 2013/028790 | 2/2013 |

OTHER PUBLICATIONS

Habazaki et al., "Corrosion behaviour of amorphous Ni—Cr—Nb—P—B bulk alloys in 6M HCl solution," *Material Science and Engineering*, A318, 2001, pp. 77-86.

Murakami (Editor), *Stress Intensity Factors Handbook*, vol. 2, Oxford: Pergamon Press, 1987, 4 pages.

Yokoyama et al., "Viscous Flow Workability of Ni—Cr—P—B Metallic Glasses Produced by Melt-Spinning in Air," *Materials Transactions*, vol. 48, No. 12, 2007, pp. 3176-3180.

Habazaki et al., "Preparation of corrosion-resistant amorphous Ni—Cr—P—B bulk alloys containing molybdenum and tantalum," *Material Science and Engineering*, A304-306, 2001, pp. 696-700.

Zhang et al., "The Corrosion Behavior of Amorphous Ni—Cr—P Alloys in Concentrated Hydrofluoric Acid," *Corrosion Science*, vol. 33, No. 10, pp. 1519-1528, 1992.

Katagiri et al., "An attempt at preparation of corrosion-resistant bulk amorphous Ni—Cr—Ta—Mo—P—B alloys," Corrosion Science, vol. 43, No. 1, pp. 183-191, 2001.

Park T.G. et al., "Development of new Ni-based amorphous alloys containing no metalloid that have large undercooled liquid regions," *Scripta Materialia*, vol. 43, No. 2, 2000, pp. 109-114.

Mitsuhashi A. et al., "The corrosion behavior of amorphous nickel base alloys in a hot concentrated phosphoric acid," *Corrosion Science*, vol. 27, No. 9, 1987, pp. 957-970.

Kawashima A. et al., "Change in corrosion behavior of amorphous Ni—P alloys by alloying with chromium, molybdenum or tungsten," *Journal of Non-Crystalline Solids*, vol. 70, No. 1, 1985, pp. 69-83.

Abrosimova G. E. et al., "Phase segregation and crystallization in the amorphous alloy $Ni_{70}Mo_{10}P_{20}$," *Physics of the Solid State*, vol. 40., No. 9, 1998, pp. 1429-1432.

Yokoyama M. et al., "Hot-press workability of Ni-based glassy alloys in supercooled liquid state and production of the glassy alloy separators for proton exchange membrane fuel cell," *Journal of the Japan Society of Powder and Powder Metallurgy*, vol. 54, No. 11, 2007, pp. 773-777.

Rabinkin et al., "Brazing Stainless Steel Using New MBF-Series of Ni—Cr—B—Si Amorphous Brazing Foils: New Brazing Alloys Withstand High-Temperature and Corrosive Environments," *Welding Research Supplement*, 1998, pp. 66-75.

Chen S.J. et al., "Transient liquid-phase bonding of T91 steel pipes using amorphous foil," *Materials Science and Engineering A*, vol. 499, No. 1-2, 2009, pp. 114-117.

Hartmann, Thomas et al., "New Amorphous Brazing Foils for Exhaust Gas Application," *Proceedings of the 4th International Brazing and Soldering Conference*, Apr. 26-29, 2009, Orlando, Florida, USA.

U.S. Appl. No. 14/501,779, filed Sep. 30, 2014, Na et al.

U.S. Appl. No. 14/824,733, filed Aug. 12, 2015, Na et al.

U.S. Appl. No. 14/797,878, filed Jul. 13, 2015, Na et al.

* cited by examiner

BULK NICKEL-PHOSPHORUS-BORON GLASSES BEARING CHROMIUM AND TANTALUM

CROSS-REFERENCE TO RELATED APPLICATIONS

The present application claims priority to U.S. Provisional Patent Application No. 61/726,740, entitled "Bulk Nickel-Phosphorus-Boron Glasses Bearing Chromium and Tantalum", filed on Nov. 15, 2012, which is incorporated herein by reference in its entirety.

TECHNICAL FIELD

The present disclosure relates to Ni—Cr—Ta—P—B glasses capable of forming metallic glass rods with diameters greater than 3 mm and as large as 7 mm or larger.

BACKGROUND

Bulk-glass forming Ni—Cr—Nb—P—B alloys capable of forming metallic glass rods with diameters of 3 mm or greater have been disclosed in recent applications: (1) U.S. Patent Application No. 61/720,015, entitled "Bulk Nickel-Based Chromium and Phosphorous Bearing Metallic Glasses with High Toughness", filed on Oct. 30, 2012, and (2) U.S. patent application Ser. No. 14/067,521, filed on Oct. 30, 2013. Each of the foregoing applications is incorporated herein by reference. In these earlier applications, Ni-based alloys with a Cr content of between 5 and 9 atomic percent, a Nb content of between 3 and 4 atomic percent, a B content of about 3 atomic percent, and a P content of about 16.5 atomic percent, were capable of forming metallic glass rods with diameters as large as 11 mm or larger. In these earlier applications, it was also disclosed that Ta can partially substitute Nb without significantly affecting glass-forming ability.

Commercial sourcing of the elements in an alloy can significantly affect the overall price associated with the commercial production of an alloy. This effect could be significant even in cases where the total concentration of an element in the alloy is relatively small, like in the case of niobium in the aforementioned alloys. Suppliers of tantalum are different from niobium. For example, the large-scale suppliers of niobium are in Brazil and Canada, but the ore in Brazil and Canada yields a small percentage of tantalum. In other countries, such as China, Ethiopia, and Mozambique, mine ores yield a higher percentage of tantalum. Tantalum is also produced as a by-product of the tin mining in Thailand and Malaysia.

Conventional Ni-based Cr, Ta, and P bearing alloys have limited glass forming ability due to the fact that the compositions require rapid solidification (cooling rates typically on the order of hundreds of thousands of degrees per second) to form an amorphous phase, and therefore the maximum thickness of metallic glass objects that can be formed from such alloys is very limited. For example, U.S. Pat. No. 5,634,989 by Hashimoto et al is directed to Ni—Cr—Ta—P—B—Si corrosion-resistant metallic glasses. Hashimoto focused primarily on achieving high-corrosion resistance for metallic glass foils. Specifically, Hashimoto requires the alloys to have the sum of the atomic percent of Cr and the atomic percent of Ta to be at least 10% to achieve passivation and to promote corrosion resistance.

However, Hashimoto only discloses the formation of very thin metallic glass foils with thicknesses ranging from 0.01 to 0.05 mm by ultra-rapid solidification, but does not describe how one would obtain specific compositions requiring low cooling rates to form bulk metallic glasses with thicknesses on the order of millimeters. Hashimoto is also silent on the mechanical properties of the bulk metallic glasses, such as their toughness. The engineering applications of two-dimensional foil-shaped articles are very limited. Examples include coating and brazing. The engineering applications of 1 to 2 mm rods are also restricted, because practically they are capable of forming only very thin engineering components with sub-millimeter thickness.

Hashimoto et al discloses Ni—Cr—Ta—P—B alloys capable of forming metallic glass rods 1 to 2 mm in diameter in a journal article (Materials Science and Engineering A304-306 (2001) 696-700, by H. Habazaki, T. Sato, K. Kawashima, K. Asami, K. Hashimoto). Hashimoto discloses that the Ni—Cr—Ta—P—B alloys include 16 at % P, 4 at % B, 5-20 at % Cr, 0-20 at % Mo, and 0-20 at % Ta. As an example, $Ni_{65}Cr_{10}Ta_5P_{16}B_4$ alloy formed an amorphous rod of 2 mm in diameter. However, no guidelines are presented in this article that would enable one skilled in the art to obtain a range of Ni—Cr—Ta—P—B alloy compositions capable of forming bulk metallic glass rods with diameters greater than 3 mm.

One requirement for broad engineering applications is a capacity to form bulk three-dimensional articles with dimensions on the order of several millimeters. For example, applications include fabricating an enclosure for electronic devices using metallic glasses, including mobile phones, tablet computers, notebook computers, instrument windows, appliance screens, and the like. Specifically, slab-shaped articles of 1 mm in thickness, or equivalent (from a cooling rate consideration, since a given amount of heat can more effectively be removed from a rod than a slab) rod-shaped articles of 3 mm in diameter, are generally regarded as the lower limits in size for broad engineering applications.

Another requirement for broad engineering applications is the ability for the millimeter-thick articles to undergo macroscopic plastic bending under load without fracturing catastrophically. This requires that the bulk metallic glasses have relatively high fracture toughness.

Accordingly, there remains a need for developing Ni—Cr—Ta—P—B alloys capable of forming bulk metallic glasses, and specifically metallic glass rods with diameters of at least 3 mm.

BRIEF DESCRIPTION OF THE DRAWINGS

The description will be more fully understood with reference to the following figures and data graphs, which are presented as various embodiments of the disclosure and should not be construed as a complete recitation of the scope of the disclosure, wherein.

BRIEF SUMMARY

Figure 1:
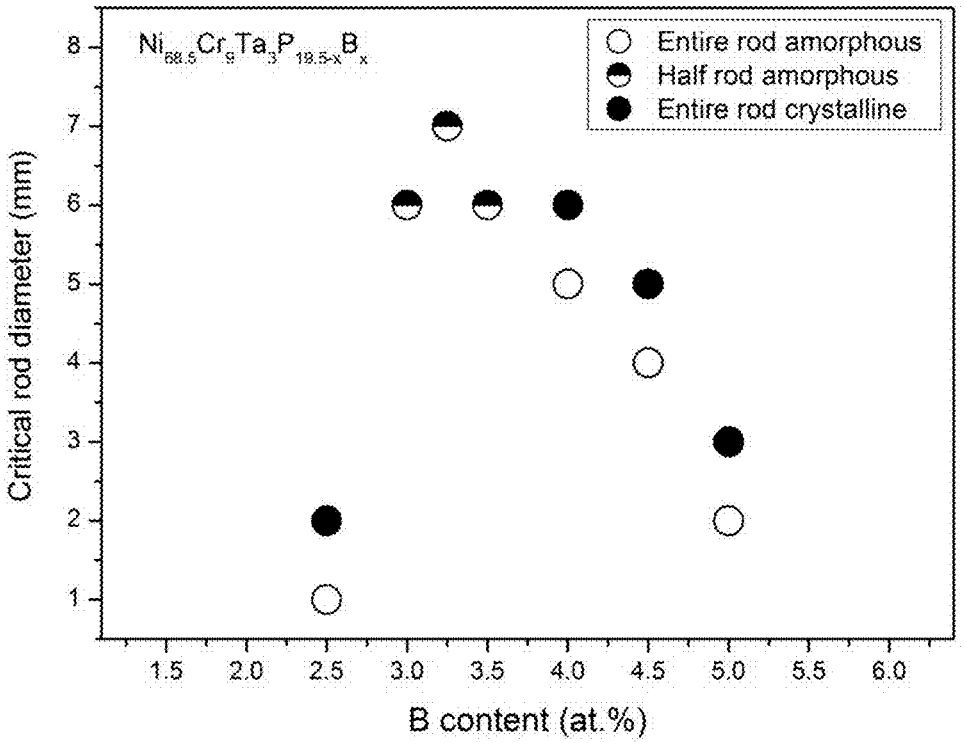
FIG. 1 illustrates the effect of substituting P by B on the glass forming ability of $Ni_{68.5}Cr_9Ta_3P_{19.5-x}B_x$ alloys in accordance with embodiments of the present disclosure.

In various embodiments, the disclosure provides Ni—Cr—Ta—P—B alloys capable of forming metallic glass rods with diameters greater than 3 mm.

The disclosure is directed to a metallic glass or an alloy represented by the following formula (subscripts denote atomic percent):

$$Ni_{(100-a-b-c-d)}Cr_aTa_bP_cB_d \qquad \text{Equation (1)}$$

where:

the atomic percent of a is between 3 and 11, the atomic percent of b is between 1.75 and 4, the atomic percent of c is between 14 and 17.5, and the atomic percent of d is between 2.5 and 5, and wherein the alloy is capable of forming a metallic glass having a lateral dimension of at least 3 mm.

In another embodiment, b is determined by x+y·a, where x is between 1.5 and 2 and y is between 0.1 and 0.15.

In another embodiment, a is between 8 and 10.5, b is between 2.75 and 3.25, and wherein the alloy is capable of forming a metallic glass having a lateral dimension of at least 5 mm.

In another embodiment, a is between 6 and 8, b is between 2.5 and 3, and wherein the alloy is capable of forming a metallic glass having a lateral dimension of at least 5 mm.

In another embodiment, x is between 1.85 and 1.9, y is between 0.12 and 0.13, and wherein the alloy is capable of forming a metallic glass having a lateral dimension of at least 5 mm.

In another embodiment, x is 1.875, y is 0.125, and wherein the alloy is capable of forming a metallic glass having a lateral dimension of at least 6 mm.

In another embodiment, a+b is less than 10, and wherein the alloy is capable of forming a metallic glass having a lateral dimension of at least 5 mm.

In another embodiment, c is between 16 and 17, and wherein the alloy is capable of forming a metallic glass having a lateral dimension of at least 5 mm.

In another embodiment, d is between 3 and 4, and wherein the alloy is capable of forming a metallic glass having a lateral dimension of at least 5 mm.

In yet another embodiment, up to 1 atomic percent of P is substituted by Si.

In yet another embodiment, up to 2 atomic percent of Cr is substituted by Fe, Co, Mn, W, Mo, Ru, Re, Cu, Pd, Pt, or combinations thereof.

In yet another embodiment, up to 2 atomic percent of Ni is substituted by Fe, Co, Mn, W, Mo, Ru, Re, Cu, Pd, Pt, or combinations thereof.

In yet another embodiment, up to 1 atomic percent of Ta is substituted by Nb or V, or combinations thereof.

In yet another embodiment, the melt is fluxed with a reducing agent prior to rapid quenching.

In yet another embodiment, the temperature of the melt prior to quenching is at least 100 degrees above the liquidus temperature of the alloy.

In yet another embodiment, the temperature of the melt prior to quenching is at least 1100° C.

In yet another embodiment, the stress intensity factor at crack initiation when measured on a 3 mm diameter rod containing a notch with length between 1 and 2 mm and root radius between 0.1 and 0.15 mm is at least 40 MPa $m^{1/2}$.

In yet another embodiment, a wire made of such metallic glass having a diameter of 1 mm can undergo macroscopic plastic deformation under bending load without fracturing catastrophically.

The disclosure is also directed to metallic glass compositions or alloy compositions $Ni_{68.5}Cr_9Ta_3P_{16.5}B_3$, $Ni_{68.5}Cr_9Ta_3P_{16.25}B_{3.25}$, $Ni_{68.5}Cr_9Ta_3P_{16}B_{3.5}$, $Ni_{69.5}Cr_8Ta_3P_{16.25}B_{3.25}$, $Ni_{67.5}Cr_{10}Ta_3P_{16.25}B_{3.25}$, $Ni_{68.08}Cr_{8.94}Ta_{2.98}P_{16.67}B_{3.33}$, $Ni_{71.31}Cr_{6.5}Ta_{2.69}P_{16.25}B_{3.25}$, $Ni_{70.75}Cr_7Ta_{2.75}P_{16.25}B_{3.25}$, $Ni_{70.19}Cr_{7.5}Ta_{2.81}P_{16.25}B_{3.25}$, $Ni_{67.94}Cr_{9.5}Ta_{3.06}P_{16.25}B_{3.25}$, $Ni_{70.25}Cr_7Ta_{3.25}P_{16.25}B_{3.25}$, $Ni_{71}Cr_7Ta_{2.5}P_{16.25}B_{3.25}$, $Ni_{69.75}Cr_8Ta_{2.75}P_{16.25}B_{3.25}$, $Ni_{68.5}Cr_9Ta_3P_{15.75}B_{3.25}Si_{0.5}$, and $Ni_{68.5}Cr_9Ta_3P_{15.25}B_{3.25}Si_1$.

Additional embodiments and features are set forth in part in the description that follows, and in part will become apparent to those skilled in the art upon examination of the specification or may be learned by the practice of the invention. A further understanding of the nature and advantages of the present invention may be realized by reference to the remaining portions of the specification and the drawings, which forms a part of this disclosure.

DETAILED DESCRIPTION

Description of Alloy Compositions

In accordance with the provided disclosure and drawings, Ni—Cr—P—B alloys containing Ta and being entirely free of Nb are capable of forming bulk metallic glasses having glass-forming ability (GFA) comparable to the Ni—Cr—Nb—P—B alloys. Specifically, Ni-based compositions with a Cr content of between 3 and 11 atomic percent, a Ta content of between 1.75 and 4 atomic percent, a P content of between 14 and 17.5 atomic percent, and a B content of between 2.5 and 5 atomic percent, were capable of forming metallic glass rods with diameters of at least 3 mm.

In some embodiments, certain Ni—Cr—Ta—P—B alloys lie along a well-defined GFA ridge, which a series of continuous cusps in GFA inside the compositional space defined by the Ta and Cr content, along which metallic glass rods with diameters of at least 6 mm can be formed. In particular embodiments, by controlling the relative concentrations of Ni, Cr, and Ta, and by incorporating minority additions of about 16.25 atomic percent of P and about 3.25 atomic percent of B, these alloys can form metallic glass rods with diameters of at least 6 mm. The compositional ridge includes alloys with good glass formability while the metallic glasses formed from the alloys demonstrate relatively high toughness.

In certain embodiments, Ni—Cr—Ta—P—B alloys demonstrating a combination of glass forming ability and toughness within the claimed range have a sum of the atomic percent of Cr and the atomic percent of Ta less than 10%, and are thus outside the ranges disclosed by Hashimoto, for example, in Tables 1-2 of Hashimoto.

In the present disclosure, "entirely free of Nb" means that Nb is present at an atomic concentration of not more than 0.1%.

In the present disclosure, the glass-forming ability of each alloy can be quantified by the "critical rod diameter", defined as maximum rod diameter in which the amorphous phase can be formed when processed by the method of water quenching a quartz tube with 0.5 mm thick wall containing a molten alloy.

The notch toughness, defined as the stress intensity factor at crack initiation $K_q$, is the measure of the material's ability to resist fracture in the presence of a notch. The notch toughness is a measure of the work required to propagate a crack originating from a notch. A high $K_q$ ensures that the material will be tough in the presence of defects.

Sample metallic glasses 1-7, showing the effect of substituting P by B according to the formula $Ni_{68.5}Cr_9Ta_3P_{19.5-x}B_x$, are presented in Table 1 and FIG. 1. As shown in Table 1, when the atomic percent of B is between 3 and 4.5 (Examples 2-6), metallic glass rods with diameters greater than 3 mm can be formed, while metallic glass rods of 7 mm diameter can be formed when the atomic percent of B is about 3.25 (Example 3).

In some embodiments where the atomic percent of B is between 3 and 4, the alloys can form bulk metallic glasses with diameters of at least 5 mm (Examples 2-5).

As shown in Table 1, the atomic percent of P varies from 14.5 to 17 for metallic glasses 1-7. When the atomic percent of P is 14.5, the critical rod diameter is less than 3 mm. In some embodiments, when the atomic percent of P is 17, the critical rod diameter is less than 2 mm. When the atomic percent of P is between 14.5 and 17, the alloys can form bulk metallic glasses having rod diameters of at least 4 mm. In some embodiments, when the atomic percent of P is between 16 and 17, the alloys can form bulk metallic glasses with diameters of at least 5 mm (Examples 2-4). In other embodiments, the alloys can form metallic glasses having rod diameters of at least 3 mm when the atomic percent of P is between 14 and 17.5.

Figure 2:
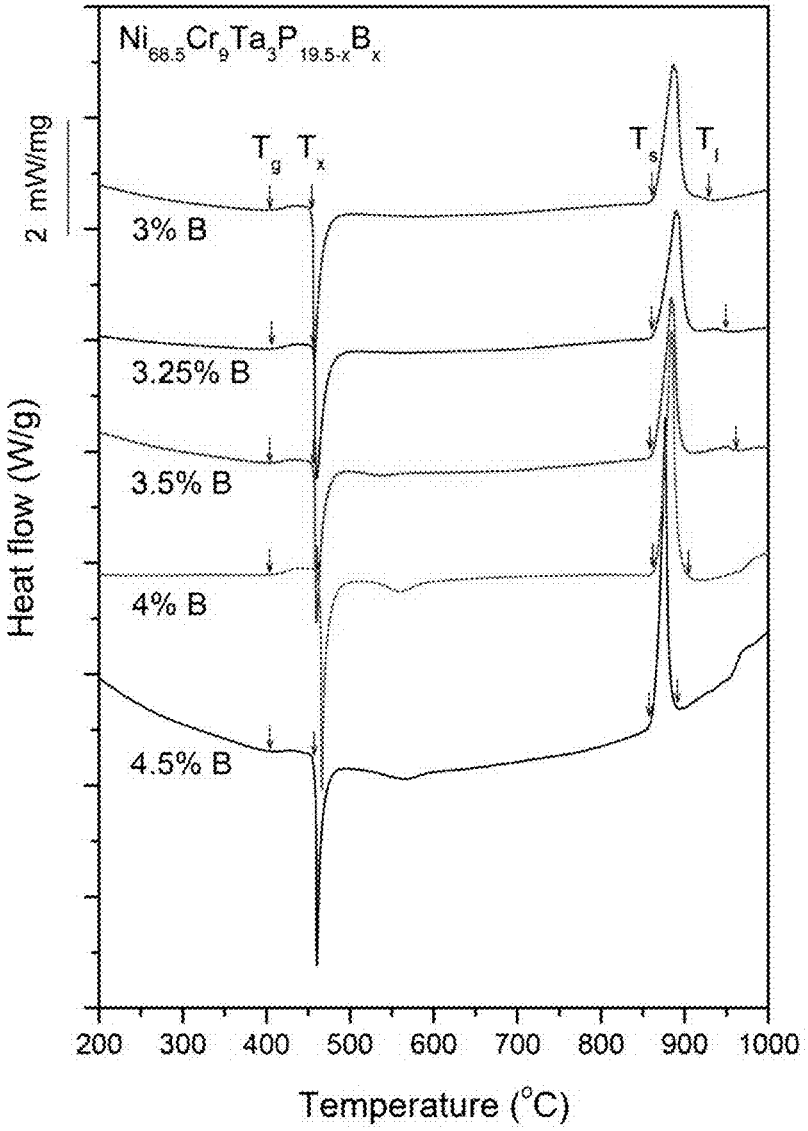
FIG. 2 provides calorimetry scans for sample metallic glasses $Ni_{68.5}Cr_9Ta_3P_{19.5-x}B_x$. Arrows indicate the glass transition, crystallization, solidus, and liquidus temperatures designated by $T_g$, $T_x$, $T_s$, and $T_l$, respectively, in accordance with embodiments of the present disclosure.

Differential calorimetry scans for metallic glasses with varying P and B are presented in FIG. 2. Arrows from left to right designate the glass-transition, crystallization, solidus and liquidus temperatures, respectively.

TABLE 1

Sample metallic glasses demonstrating the effect of substituting P by B on the glass forming ability of the Ni—Cr—Ta—P—B alloys

| Example | Composition | Critical Rod Diameter [mm] |
|---|---|---|
| 1 | $Ni_{68.5}Cr_9Ta_3P_{17}B_{2.5}$ | <2 |
| 2 | $Ni_{68.5}Cr_9Ta_3P_{16.5}B_3$ | 6 |
| 3 | $Ni_{68.5}Cr_9Ta_3P_{16.25}B_{3.25}$ | 7 |
| 4 | $Ni_{68.5}Cr_9Ta_3P_{16}B_{3.5}$ | 6 |
| 5 | $Ni_{68.5}Cr_9Ta_3P_{15.5}B_4$ | 5 |
| 6 | $Ni_{68.5}Cr_9Ta_3P_{15}B_{4.5}$ | 4 |
| 7 | $Ni_{68.5}Cr_9Ta_3P_{14.5}B_5$ | <3 |

Figure 3:
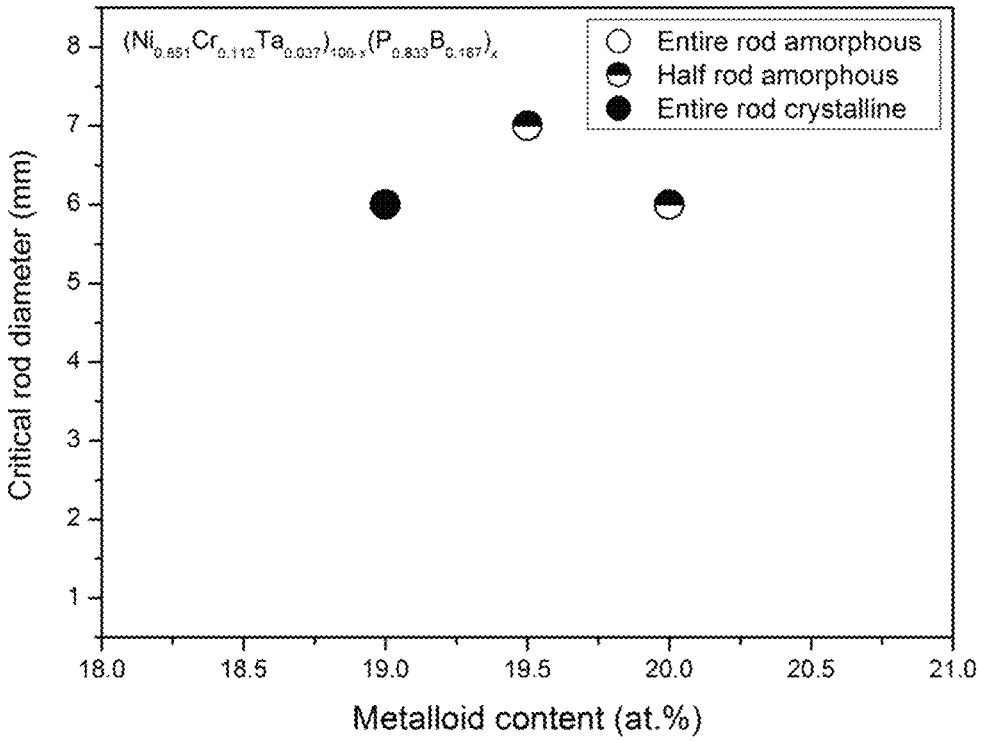
FIG. 3 illustrates the effect of varying the metal to metalloid fraction on the glass forming ability of $(Ni_{0.851}Cr_{0.112}Ta_{0.037})_{100-x}(P_{0.833}B_{0.167})_x$ alloys in accordance with embodiments of the present disclosure.

Sample metallic glasses 3 and 8-9, showing the effect of varying the metal to metalloid ratio according to the formula $(N_{0.851}Cr_{0.112}Ta_{0.037})_{100-x}(P_{0.833}B_{0.167})_x$, are presented in Table 2 and FIG. 3. As shown in FIG. 3, when the total atomic percent of metalloids (which is a sum of the atomic percent of P and B) is between 19 and 20, metallic glass rods with diameters greater than 3 mm can be formed, while metallic glass rods of 7 mm diameter can be formed when the total atomic percent of metalloids is at about 19.5.

TABLE 2

Sample metallic glasses demonstrating the effect of increasing the total metalloid concentration at the expense of metals on the glass forming ability of the Ni—Cr—Ta—P—B alloys

| Example | Composition | Critical Rod Diameter [mm] |
|---|---|---|
| 8 | $Ni_{68.92}Cr_{9.06}Ta_{3.02}P_{15.83}B_{3.17}$ | <6 |
| 3 | $Ni_{68.5}Cr_9Ta_3P_{16.25}B_{3.25}$ | 7 |
| 9 | $Ni_{68.08}Cr_{8.94}Ta_{2.98}P_{16.67}B_{3.33}$ | 6 |

Figure 4:
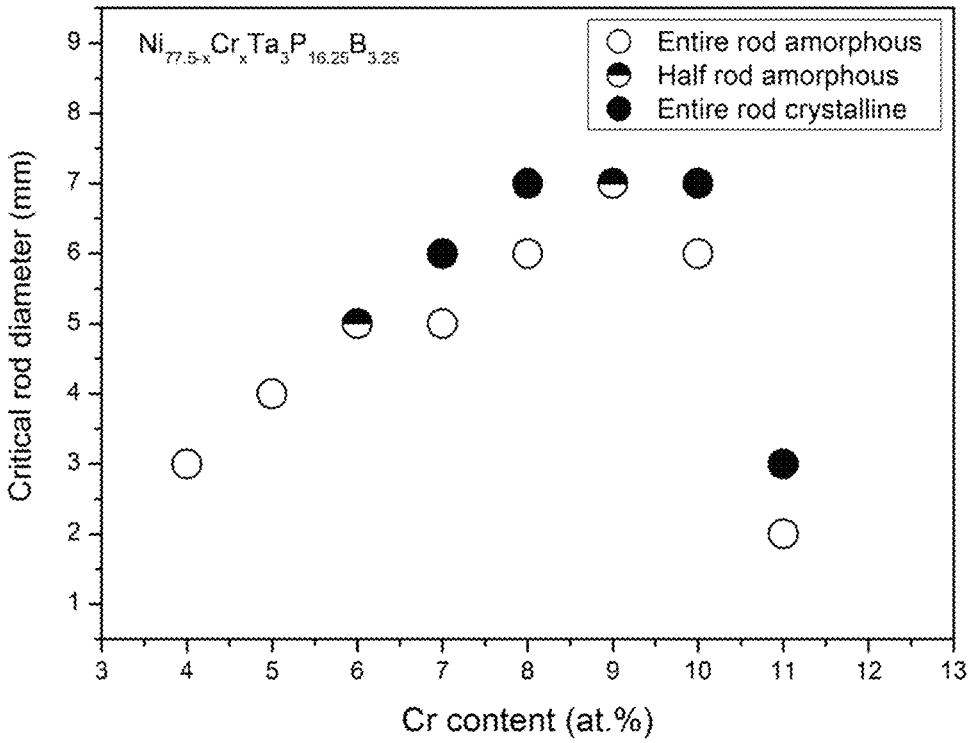
FIG. 4 illustrates the effect of substituting Ni by Cr on the glass forming ability of $Ni_{77.5-x}Cr_xTa_3P_{16.25}B_{3.25}$ alloys in accordance with embodiments of the present disclosure.

Sample metallic glasses 3 and 10-16, showing the effect of substituting Ni by Cr according to the formula $Ni_{77.5-x}Cr_xTa_3P_{16.25}B_{3.25}$, are presented in Table 3 and FIG. 4. As shown in Table 3, when the atomic percent of Cr is between 4 and 10, metallic glass rods with diameters greater than 3 mm can be formed, and when the atomic percent of Cr is at about 9, metallic glass rods of 7 mm diameter can be formed. As shown in FIG. 4, when the atomic percent of Cr is 11, a 3-mm diameter rod is entirely crystalline. When the atomic percent of Cr is 4, a 3-mm diameter rod is entirely amorphous. In other embodiments where the atomic percent of Cr is between 3 and 11, the alloys can form bulk metallic glasses with diameters of at least 3 mm.

Figure 5:
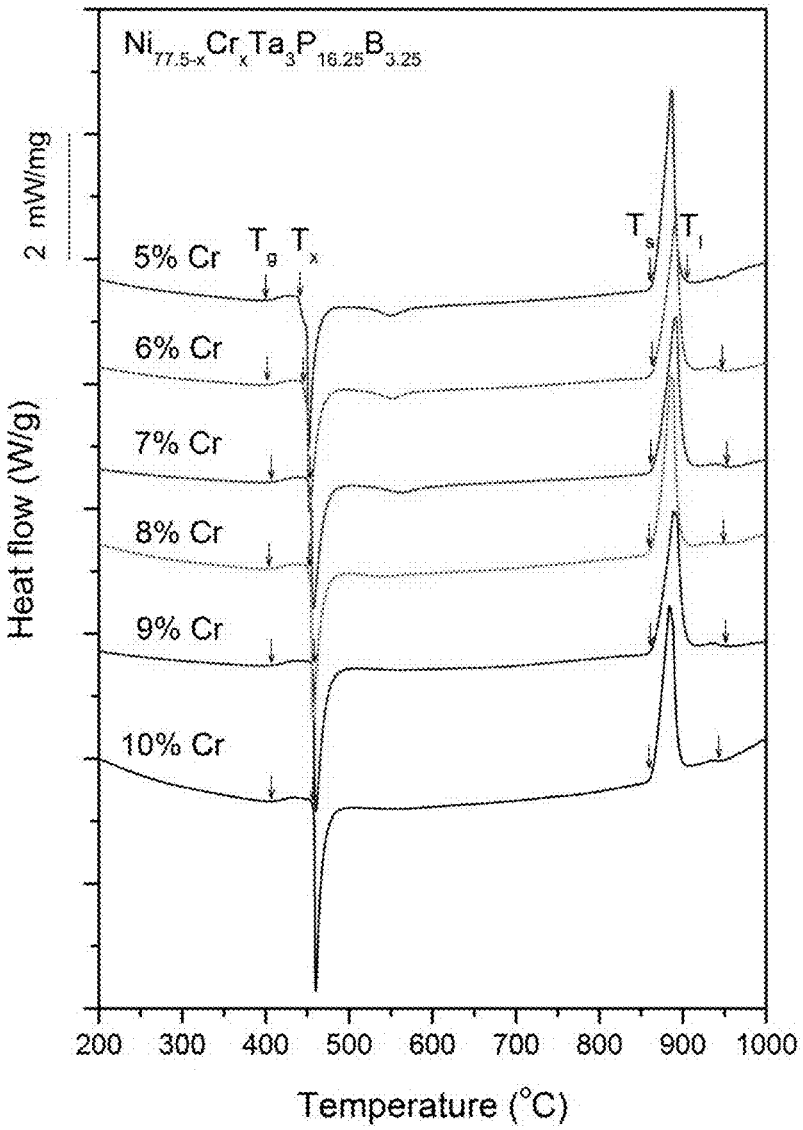
FIG. 5 provides calorimetry scans for sample metallic glasses $Ni_{77.5-x}Cr_xTa_3P_{16.25}B_{3.25}$. Arrows indicate the glass transition, crystallization, solidus, and liquidus temperatures designated by $T_g$, $T_x$, $T_s$, and $T_l$, respectively, in accordance with embodiments of the present disclosure.

Differential calorimetry scans for metallic glasses with varying Ni and Cr are presented in FIG. 5. Arrows from left to right designate the glass-transition, crystallization, solidus and liquidus temperatures, respectively.

TABLE 3

Sample metallic glasses demonstrating the effect of substituting Ni by Cr on the glass forming ability of the Ni—Cr—Ta—P—B alloys

| Example | Composition | Critical Rod Diameter [mm] |
|---|---|---|
| 10 | $Ni_{73.5}Cr_4Ta_3P_{16.25}B_{3.25}$ | 3 |
| 11 | $Ni_{72.5}Cr_5Ta_3P_{16.25}B_{3.25}$ | 4 |
| 12 | $Ni_{71.5}Cr_6Ta_3P_{16.25}B_{3.25}$ | 5 |

TABLE 3-continued

Sample metallic glasses demonstrating the effect of substituting Ni by Cr on the glass forming ability of the Ni—Cr—Ta—P—B alloys

| Example | Composition | Critical Rod Diameter [mm] |
|---|---|---|
| 13 | $Ni_{70.5}Cr_7Ta_3P_{16.25}B_{3.25}$ | 5 |
| 14 | $Ni_{69.5}Cr_8Ta_3P_{16.25}B_{3.25}$ | 6 |
| 3 | $Ni_{68.5}Cr_9Ta_3P_{16.25}B_{3.25}$ | 7 |
| 15 | $Ni_{67.5}Cr_{10}Ta_3P_{16.25}B_{3.25}$ | 6 |
| 16 | $Ni_{66.5}Cr_{11}Ta_3P_{16.25}B_{3.25}$ | <3 |

Figure 6:
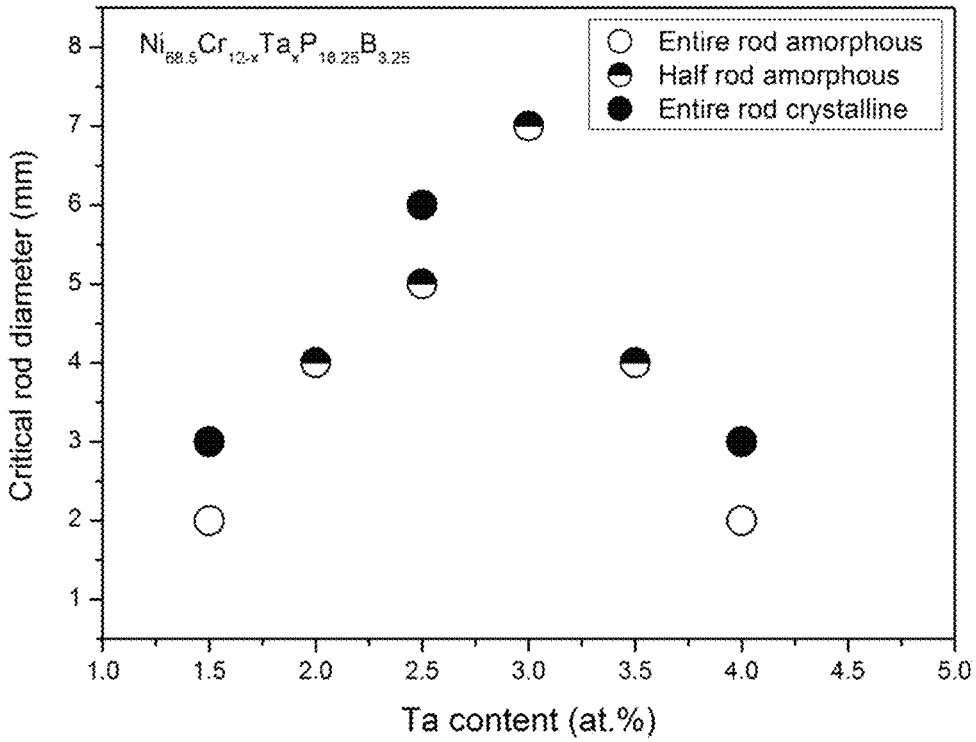
FIG. 6 illustrates the effect of substituting Cr by Ta on the glass forming ability of $Ni_{68.5}Cr_{12-x}Ta_xP_{16.25}B_{3.25}$ alloys in accordance with embodiments of the present disclosure.

Sample metallic glasses 3 and 17-21, showing the effect of substituting Cr by Ta according to the formula $Ni_{68.5}Cr_{12-x}Ta_xP_{16.25}B_{3.25}$) are presented in Table 4 and FIG. 6. As shown, when the atomic percent of Ta is between 2 and 3.5, metallic glass rods with diameters greater than 3 mm can be formed, and when the atomic percent of Ta is at about 3, metallic glass rods 7 mm in diameter can be formed. As shown in FIG. 6, when the atomic percent of Ta is at 1.5 or 4.0, a 3-mm diameter rod is entirely crystalline. In other embodiments where the atomic percent of Ta is between 1.75 and 4, the alloys can form bulk metallic glasses with diameters of at least 3 mm.

Figure 7:
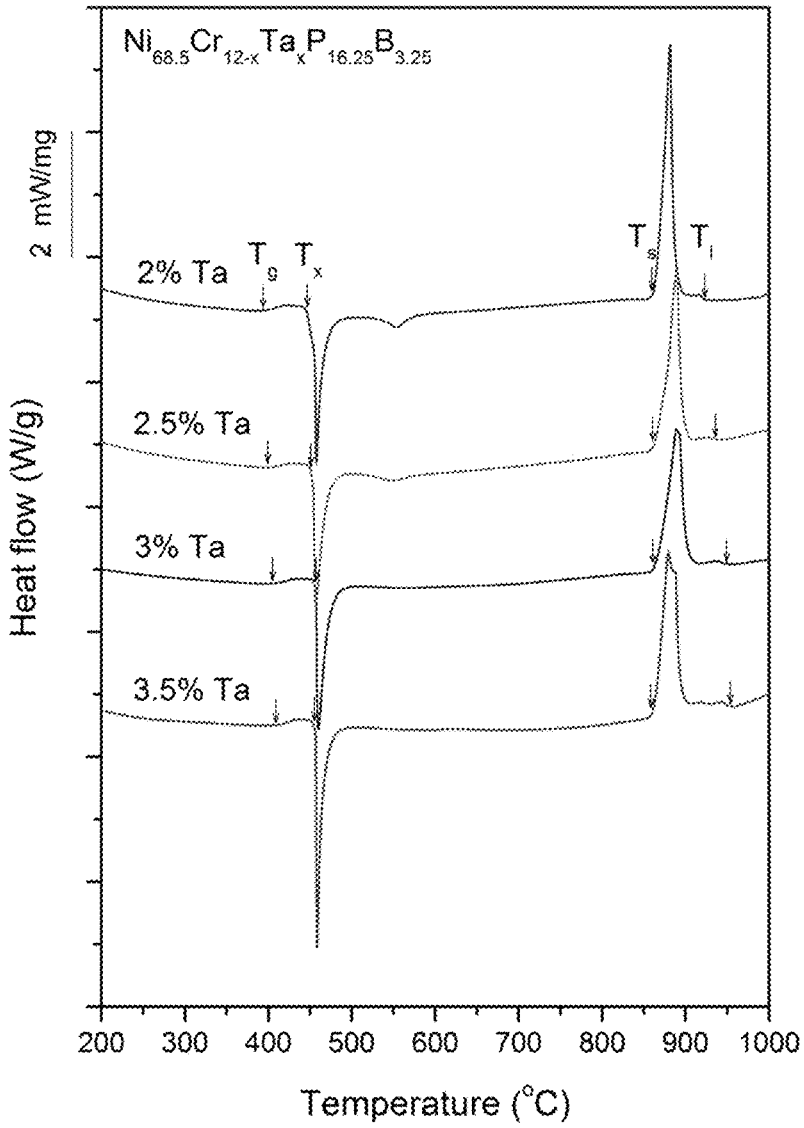
FIG. 7 provides calorimetry scans for sample metallic glasses $Ni_{68.5}Cr_{12-x}Ta_xP_{16.25}B_{3.25}$. Arrows indicate the glass transition, crystallization, solidus, and liquidus temperatures designated by $T_g$, $T_x$, $T_s$, and $T_l$, respectively, in accordance with embodiments of the present disclosure.

Differential calorimetry scans for metallic glasses with Cr and Ta are presented in FIG. 7. Arrows from left to right designate the glass-transition, crystallization, solidus and liquidus temperatures, respectively.

TABLE 4

Sample metallic glasses demonstrating the effect of substituting Cr by Ta on the glass forming ability of the Ni—Cr—Ta—P—B alloys

| Example | Composition | Critical Rod Diameter [mm] |
|---|---|---|
| 17 | $Ni_{68.5}Cr_{10.5}Ta_{1.5}P_{16.25}B_{3.25}$ | <3 |
| 18 | $Ni_{68.5}Cr_{10}Ta_2P_{16.25}B_{3.25}$ | 4 |
| 19 | $Ni_{68.5}Cr_{9.5}Ta_{2.5}P_{16.25}B_{3.25}$ | 5 |
| 3 | $Ni_{68.5}Cr_9Ta_3P_{16.25}B_{3.25}$ | 7 |
| 20 | $Ni_{68.5}Cr_{8.5}Ta_{3.5}P_{16.25}B_{3.25}$ | 4 |
| 21 | $Ni_{68.5}Cr_8Ta_4P_{16.25}B_{3.25}$ | <3 |

In some embodiments according to Equation (1), the atomic percent of Ta can be determined based on the atomic percent of Cr according to Equation (2), $$b=x+y*a \qquad \text{Equation (2)}$$

where x is between 1.5 and 2 and y is between 0.1 and 0.15. Within these ranges according to Equation (3), the alloys can form metallic glasses with diameters of at least 3 mm.

In some embodiments according to Equation (2), when x is between 1.85 and 1.9 and y is between 0.12 and 0.13 according to Equation (3), the alloys can form metallic glasses with diameters of at least 5 mm.

In embodiments according to Equations (1) and (2), the atomic percents of P and B are fixed at 16.25 and 3.25, respectively, while Ni is substituted by both Cr and Ta according to Equation (3) below are listed in Table 5.

$$Ni_{80.5-a-b}Cr_aTa_bP_{16.25}B_{3.25} \qquad \text{Equation (3)}$$

Sample metallic glasses 3 and 22-33, showing the effect of substituting Ni by both Cr and Ta according to Equation (3) are listed in Table 5. In Equation (3), the atomic percent of Ta may be determined based on the atomic percent of Cr according to the Equation (4), $$b=0.125a+1.875 \qquad \text{Equation (4)}$$

Equation (4) lies approximately midway along the range associated with Equation (2). By inserting Equation (4) into Equation (3), Equation (5) is obtained, $$Ni_{78.625-1.125a}Cr_aTa_{0.125a+1.875}P_{16.25}B_{3.25} \qquad \text{Equation (5)}$$

which defines a compositional ridge along which alloys have a glass forming ability of at least 6 mm in the two-dimensional composition space defined by the atomic concentrations of Ta and Cr. Sample alloys 3 and 22-26 presented in Table 5 lie along the ridge defined by Equation (5) above. Specifically, when b is between about 2.5 and about 3.25 (see the atomic percent of Ta varying from 2.69 to 3.06 in metallic glasses 3 and 22-26 in Table 5), alloys that satisfy the Equation (5) can form metallic glass rods with diameters between 6 and 7 mm.

Figure 8:
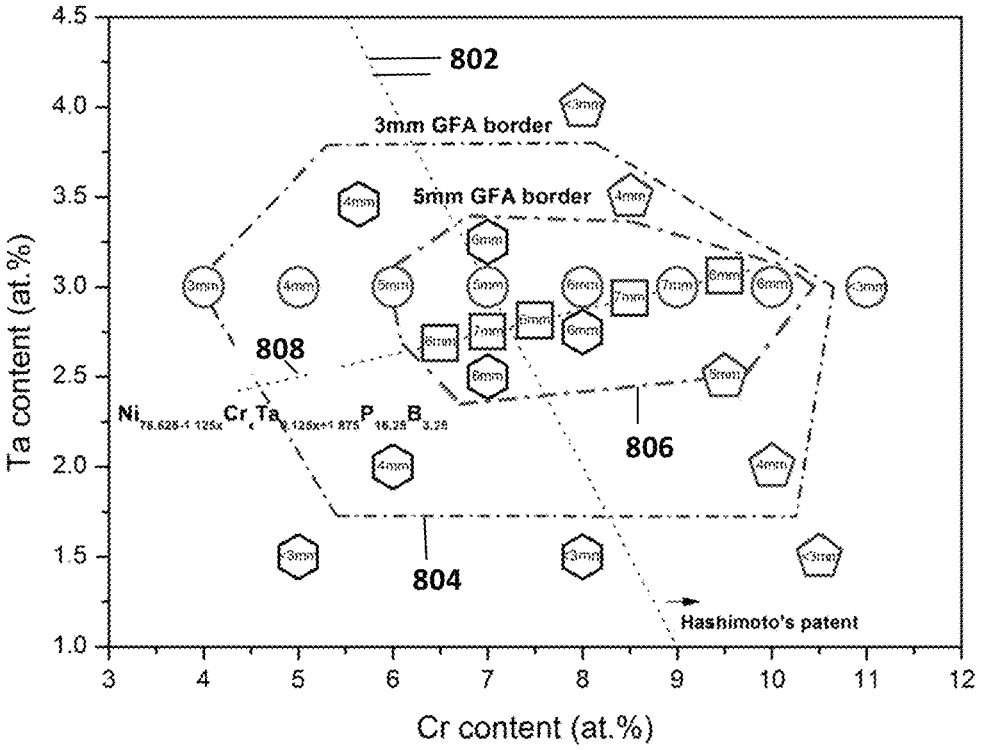
FIG. 8 illustrates the effect of substituting Ni by both Cr and Ta on the glass forming ability of $Ni_{80.5-x-y}Cr_xTa_yP_{16.25}B_{3.25}$ alloys in accordance with embodiments of the present disclosure.

FIG. 8 provides a contour plot of the critical rod diameter as a function of the atomic percent of Cr and Ta as horizontal and vertical axes, respectively. The plot includes dashline 808 that designates the ridge defined by Equation (5). The plot also includes contour line 806 designating the boundary for critical rod diameter of 5 mm, and contour line 804 designating the boundary for critical rod diameter of 3 mm. Within contour line 806, the critical rod diameter is at least 5 mm, while within contour line 804 the critical rod diameter is at least 3 mm. FIG. 8 shows the data points listed in Table 5 and in the previous tables.

TABLE 5

Sample metallic glasses according to the formula $Ni_{80.5-a-b}Cr_aTa_bP_{16.25}B_{3.25}$

| Example | Composition | Critical Rod Diameter [mm] | Total atomic percent of Cr and Ta |
|---|---|---|---|
| 22 | $Ni_{71.31}Cr_{6.5}Ta_{2.69}P_{16.25}B_{3.25}$ | 6 | 9.19 |
| 23 | $Ni_{70.75}Cr_7Ta_{2.75}P_{16.25}B_{3.25}$ | 7 | 9.75 |
| 24 | $Ni_{70.19}Cr_{7.5}Ta_{2.81}P_{16.25}B_{3.25}$ | 6 | 10.31 |
| 25 | $Ni_{69.06}Cr_{8.5}Ta_{2.94}P_{16.25}B_{3.25}$ | 7 | 11.44 |
| 3 | $Ni_{68.5}Cr_9Ta_3P_{16.25}B_{3.25}$ | 7 | 12 |
| 26 | $Ni_{67.94}Cr_{9.5}Ta_{3.06}P_{16.25}B_{3.25}$ | 6 | 12.56 |
| 27 | $Ni_{70.25}Cr_7Ta_{3.25}P_{16.25}B_{3.25}$ | 6 | 10.25 |
| 28 | $Ni_{71}Cr_7Ta_{2.5}P_{16.25}B_{3.25}$ | 6 | 9.25 |
| 29 | $Ni_{69.75}Cr_8Ta_{2.75}P_{16.25}B_{3.25}$ | 6 | 10.75 |
| 30 | $Ni_{72.5}Cr_6Ta_2P_{16.25}B_{3.25}$ | 4 | 8 |
| 31 | $Ni_{71.4}Cr_{5.64}Ta_{3.46}P_{16.25}B_{3.25}$ | 4 | 9.1 |
| 32 | $Ni_{74}Cr_5Ta_{1.5}P_{16.25}B_{3.25}$ | <3 | 6.5 |
| 33 | $Ni_{71}Cr_8Ta_{1.5}P_{16.25}B_{3.25}$ | <3 | 9.5 |

Sample metallic glasses 3 and 34-36, showing the effect of substituting P by Si according to the formula $Ni_{68.5}Cr_9Ta_3P_{16.25-x}B_{3.25}Si_x$, are listed in Table 6. As shown, Si substitution of P of up to about 1% has negligible influence or brings a slight improvement in the glass forming ability of Ni—Cr—Ta—P—B alloys.

TABLE 6

Sample metallic glasses Ni—Cr—Ta—P—B—Si demonstrating the effect of substituting P by Si on the glass forming ability of the Ni—Cr—Ta—P—B alloys

| Example | Composition | Critical Rod Diameter [mm] |
|---|---|---|
| 3 | $Ni_{68.5}Cr_9Ta_3P_{16.25}B_{3.25}$ | 7 |
| 34 | $Ni_{68.5}Cr_9Ta_3P_{15.75}B_{3.25}Si_{0.5}$ | 7 |

TABLE 6-continued

Sample metallic glasses Ni—Cr—Ta—P—B—Si demonstrating the effect of substituting P by Si on the glass forming ability of the Ni—Cr—Ta—P—B alloys

| Example | Composition | Critical Rod Diameter [mm] |
|---|---|---|
| 35 | $Ni_{68.5}Cr_9Ta_3P_{15.25}B_{3.25}Si_1$ | 7 |
| 36 | $Ni_{68.5}Cr_9Ta_3P_{14.75}B_{3.25}Si_{1.5}$ | <7 |

Figure 9:
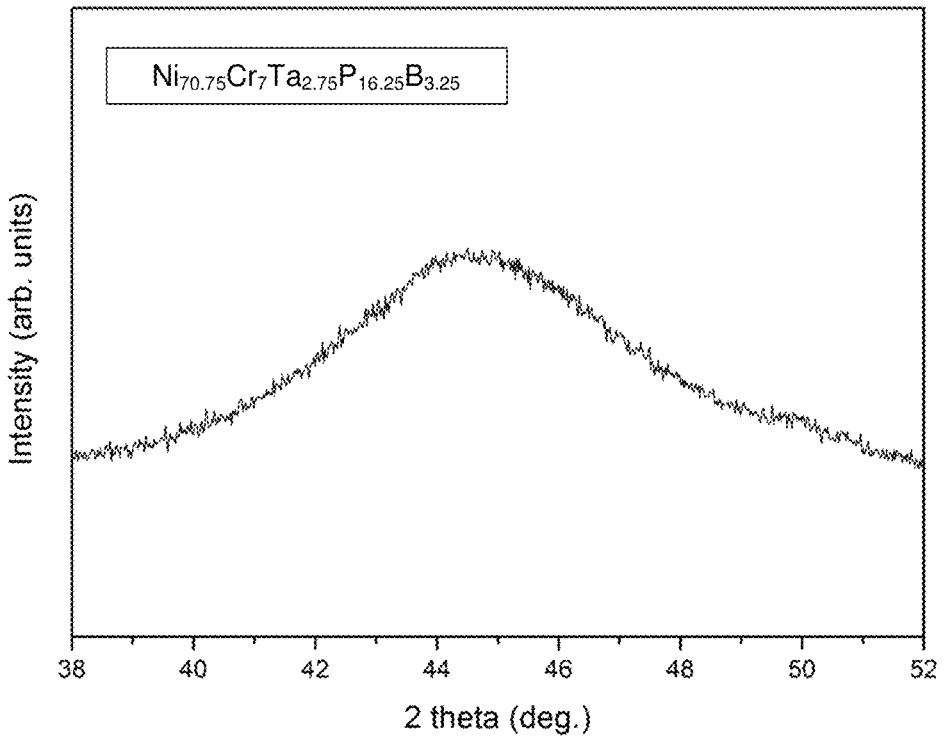
FIG. 9 provides an X-ray diffractogram verifying the amorphous structure of a 7 mm diameter rod of $Ni_{68.5}Cr_9Ta_3P_{15.75}B_{3.25}Si_{0.5}$ (metallic glass 34) in accordance with embodiments of the present disclosure.

The x-ray diffractogram verifying the amorphous structure of a 7 mm diameter rod of $Ni_{68.5}Cr_9Ta_3P_{15.75}B_{3.25}Si_{0.5}$ (metallic glass 34) is presented in FIG. 9. The diffractogram is taken at the top cross section of a vertically cast rod, verifying that the entire rod is amorphous.

The measured notch toughness of several sample metallic glasses 3, 12, 23, 31, and 34-35 is listed along with critical rod diameters in Table 7. The notch toughness of the sample metallic glasses is shown to vary from about 40 to about 80 MPa $m^{1/2}$. Alloy $Ni_{70.75}Cr_7Ta_{2.75}P_{16.25}B_{3.25}$ (metallic glass 23) demonstrates a combination of good glass forming ability and high toughness, as it exhibits a 7 mm critical rod diameter and 79.3 MPa $m^{1/2}$ notch toughness.

TABLE 7

Notch toughness and critical rod diameter of sample metallic glasses Ni—Cr—Ta—P—B and Ni—Cr—Ta—P—B—Si

| Example | Composition | Critical Rod Diameter [mm] | Notch Toughness $K_Q$ (MPa $m^{1/2}$) |
|---|---|---|---|
| 3 | $Ni_{68.5}Cr_9Ta_3P_{16.25}B_{3.25}$ | 7 | 51.8 ± 4.8 |
| 31 | $Ni_{71.4}Cr_{5.64}Ta_{3.46}P_{16.25}B_{3.25}$ | 4 | 54.1 ± 3.0 |
| 23 | $Ni_{70.75}Cr_7Ta_{2.75}P_{16.25}B_{3.25}$ | 7 | 79.3 ± 5.6 |
| 12 | $Ni_{71.5}Cr_6Ta_3P_{16.25}B_{3.25}$ | 5 | 40.2 ± 4.5 |
| 34 | $Ni_{68.5}Cr_9Ta_3P_{15.75}B_{3.25}Si_{0.5}$ | 7 | 60.1 ± 4.3 |
| 35 | $Ni_{68.5}Cr_9Ta_3P_{15.25}B_{3.25}Si_1$ | 7 | 56.0 ± 4.5 |

Various thermophysical, mechanical, and chemical properties of the metallic glasses were investigated. Measured thermophysical properties include glass-transition, crystallization, solidus and liquidus temperatures, density, shear modulus, bulk modulus, Young's modulus, and Poisson's ratio. Measured mechanical properties, in addition to notch toughness, include compressive yield strength and hardness. Measured chemical properties include corrosion resistance in 6M HCl. These properties are listed in Table 8.

TABLE 8

Thermophysical, Mechanical, and chemical properties for Sample metallic glass $Ni_{70.75}Cr_7Ta_{2.75}P_{16.25}B_{3.25}$.

| | |
|---|---|
| Composition | $Ni_{70.75}Cr_7Ta_{2.75}P_{16.25}B_{3.25}$ |
| Critical rod diameter | 7 mm |
| Glass-transition temperature | 399.4° C. |
| Crystallization temperature | 440.8° C. |
| Solidus temperature | 860.4° C. |
| Liquidus temperature | 911.9° C. |
| Density | 8.19 g/cc |
| Yield strength (compressive) | 2425 MPa |
| Hardness | 708.2 ± 5.4 kgf/$mm^2$ |
| Notch toughness | 79.3 MPa $m^{1/2}$ |
| Plastic zone radius | 0.34 mm |
| Shear modulus | 49.5 GPa |
| Bulk modulus | 177.7 GPa |
| Young's modulus | 135.9 GPa |
| Poisson's ratio | 0.3726 |
| Corrosion rate (6M HCl) | 10.7 μm/year |

Figure 10:
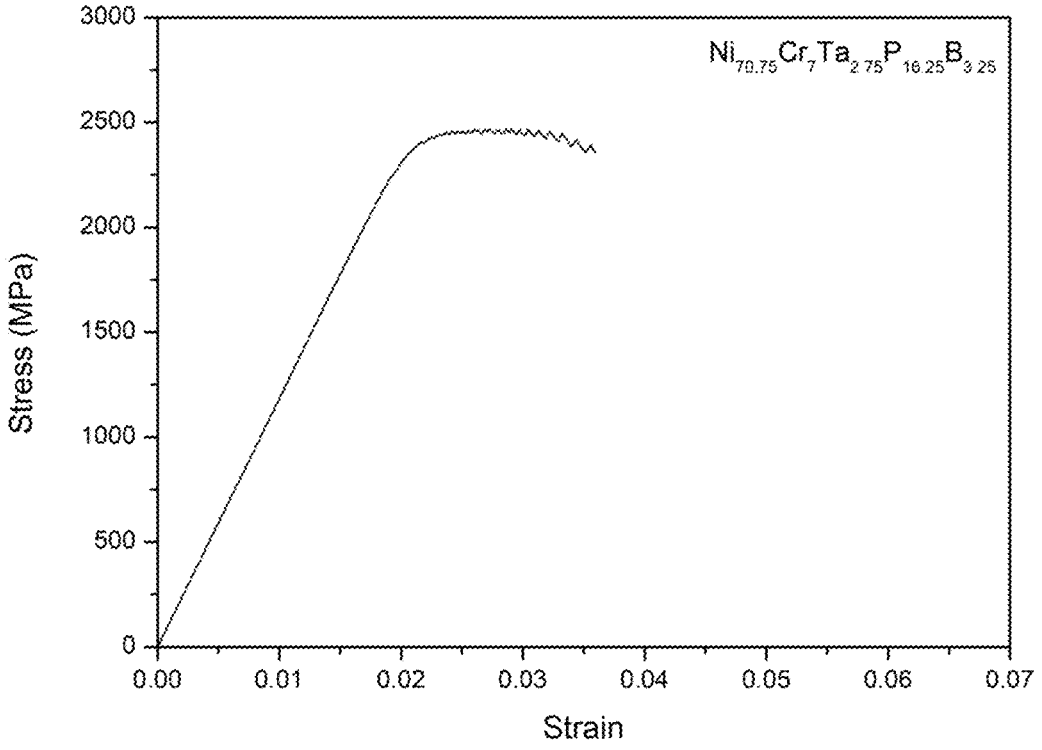
FIG. 10 provides a compressive stress-strain diagram for a sample metallic glass having composition $Ni_{70.75}Cr_7Ta_{2.75}P_{16.25}B_{3.25}$.

The yield strength, $\sigma_y$ is a measure of the material's ability to resist non-elastic yielding. The yield strength is the stress at which the material yields plastically. A high $\sigma_y$ ensures that the material will be strong. By way of example, the compressive stress-strain diagram for metallic glass $Ni_{70.75}Cr_7Ta_{2.75}P_{16.25}B_{3.25}$ is presented in FIG. 10. The compressive yield strength is estimated to be 2425 MPa, and is listed in Table 8. The compressive yield strength of all metallic glass compositions according to the current disclosure is expected to be over 2200 MPa. It is interesting to note that the material shows considerable macroscopic plastic deformation in compression, as evidenced by the stress-strain diagram.

Hardness is a measure of the material's ability to resist plastic indentation. A high hardness will ensure that the material will be resistant to indentation and scratching. The Vickers hardness of metallic glass $Ni_{70.75}Cr_7Ta_{2.75}P_{16.25}B_{3.25}$ is measured to be 708 kgf/$mm^2$. The hardness of all metallic glass compositions according to the current disclosure is expected to be over 680 kgf/$mm^2$.

A plastic zone radius, $r_p$, defined as $K_q^2/\pi\sigma_y^2$, where $\sigma_y$ is the compressive yield strength, is a measure of the critical flaw size at which catastrophic fracture is promoted. The plastic zone radius determines the sensitivity of the material to flaws; a high $r_p$ designates a low sensitivity of the material to flaws. The plastic zone radius of metallic glass $Ni_{70.75}Cr_7Ta_{2.75}P_{16.25}B_{3.25}$ is estimated to 0.34 mm.

Figure 11:
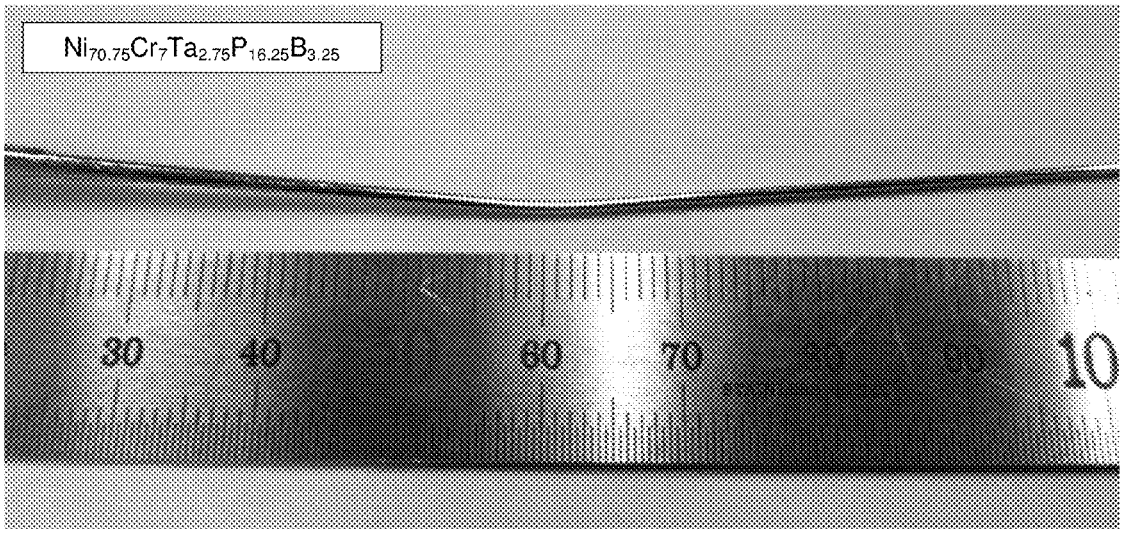
FIG. 11 provides an image of plastically bent 1 mm rod of sample metallic glass $Ni_{70.75}Cr_7Ta_{2.75}P_{16.25}B_{3.25}$ (metallic glass 23) in accordance with embodiments of the present disclosure.

The metallic glasses exhibit an exceptional bending ductility. Specifically, under an applied bending load, the alloys are capable of undergoing plastic bending in the absence of fracture for diameters up to at least 1 mm. An amorphous plastically bent rod of a 1 mm diameter section of metallic glass $Ni_{70.75}Cr_7Ta_{2.75}P_{16.25}B_{3.25}$ (metallic glass 23) is shown in FIG. 11.

Figure 12:
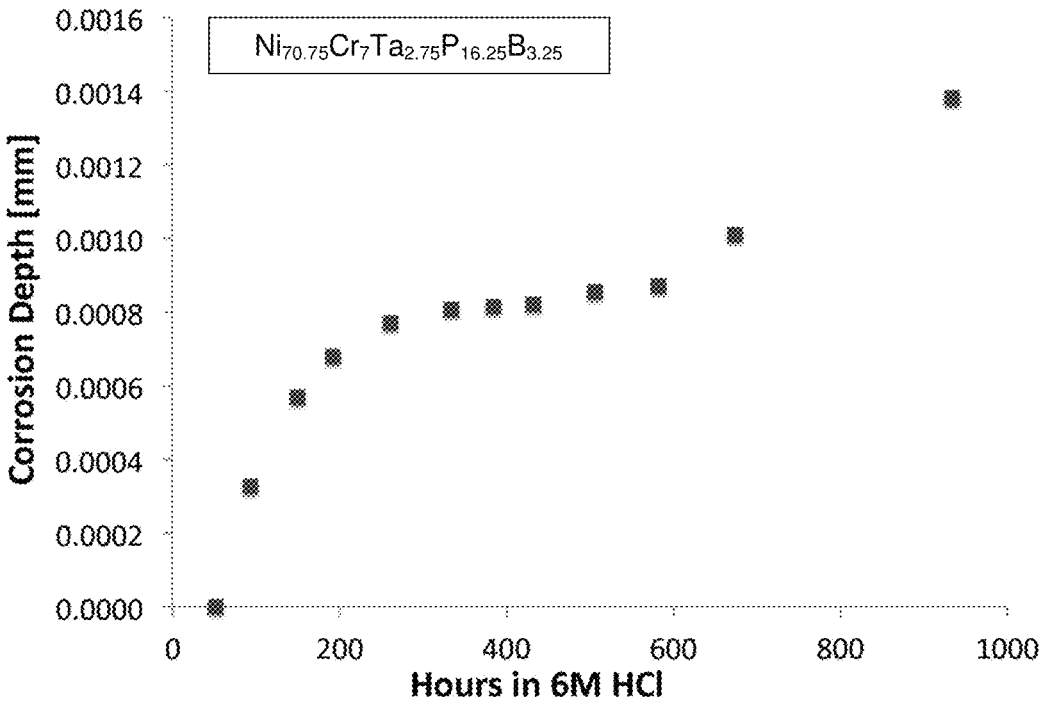
FIG. 12 provides a plot showing the corrosion depth versus time in a 6M HCl solution of a 3 mm metallic glass rod having composition $Ni_{70.75}Cr_7Ta_{2.75}P_{16.25}B_{3.25}$.

Lastly, the Ni—Cr—Ta—P—B metallic glasses also exhibit an exceptional corrosion resistance. The corrosion resistance of example metallic glass $Ni_{70.75}Cr_7Ta_{2.75}P_{16.25}B_{3.25}$ was evaluated by an immersion test in 6M HCl. The density of the metallic glass rod was measured using the Archimedes method to be 8.19 g/cc. A plot of the corrosion depth versus time is presented in FIG. 12. The corrosion depth at approximately 934 hours is measured to be about 1.3 micrometers. The corrosion rate is estimated to be 10.7 μm/year. The corrosion rate of all metallic glass compositions according to the current disclosure is expected to be under 100 μm/year.

Comparison with Previous Compositional Ranges

Hashimoto's patent does not disclose bulk metallic glass formation, that is widely understood in the art as the formation of metallic glass objects with a lateral dimension of at least 1 mm. Furthermore, the disclosed composition ranges do not demonstrate any engineering applicability beyond corrosion barrier coatings. Although certain engineering properties such as strength and hardness are properties of the metallic glass coatings of Hashimoto, others are not. Toughness can be a property of bulk samples having lateral dimensions of at least 1 mm. Since Hashimoto's patent is limited only to sub-millimeter thick ribbons, Hashimoto has not demonstrated a toughness of at least 40 MPa $m^{1/2}$, as presently disclosed.

The dotted line 802 in FIG. 8 indicates the compositional boundary of Hashimoto's patent claiming Ni—Cr—Ta—P—B alloys having a combined atomic percent of Cr and Ta of at least 10. As seen in FIG. 8 and Table 5, the region claimed by Hashimoto's patent (U.S. Pat. No. 5,634,989) barely overlaps with the region claimed in the present disclosure. The combined atomic percent of Cr and Ta for Example alloys 3 and 22-33 is listed in Table 5. Alloys having a combined atomic percent of Cr and Ta between 10 and 12.5 (Example metallic glasses 3, 24, 25, 26, 27, and 29 in Table 5) are capable of forming metallic glass rods with diameters between 6 and 7 mm. Alloys having a combined atomic percent of Cr and Ta in excess of 13 are limited to critical rod diameters of less than 3 mm. The region covered in Hashimoto's patent (to the right of dashline 802) having combined atomic percent of Cr and Ta considerably higher than 13 includes alloys that are marginal glass formers capable of forming only sub-millimeter thick ribbons suitable only as corrosion barrier coatings, which was the focus and scope of the Hashimoto patent.

However, a significant fraction of the presently claimed bulk metallic glass forming region falls outside the Hashimoto boundary (i.e. to the left of the dashline 802), where the combined atomic percent of Cr and Ta is less than 10. In this region, bulk metallic glass formers are capable of forming metallic glass rods with diameters of 3 mm or larger. Specifically, alloys with a combined atomic percent of Cr and Ta between 9 and 10 are capable of forming metallic glass rods with diameters between 6 and 7 mm (Example metallic glasses 22, 23, and 28, which are within 5 mm boundary 806 and to the left of dashline 802), while alloys with a combined atomic percent of Cr and Ta as low as 7 are capable of forming metallic glass rods with diameters of 3 mm or more (Example metallic glass 10 shown in Table 3, which is on 3 mm boundary 804 shown in FIG. 8). Alloy $Ni_{70.75}Cr_7Ta_{2.75}P_{16.25}B_{3.25}$ (metallic glass 23) which demonstrates a combination of good glass forming ability and high toughness (7 mm critical rod diameter and 79.3 MPa $m^{1/2}$ notch toughness), has a combined atomic percent of Cr and Ta of 9.75, and is likewise outside the Hashimoto patent.

Description of Methods of Processing the Sample Alloys to Form Amorphous Articles A method for producing the alloy ingots involves inductive melting of the appropriate amounts of elemental constituents in a quartz tube under inert atmosphere. The purity levels of the constituent elements were as follows: Ni 99.995%, Cr 99.996%, Ta 99.95%, Si 99.9999%, P 99.9999%, and B 99.5%. The melting crucible may alternatively be a ceramic such as alumina, zirconia, graphite, sintered crystalline silica, or a water-cooled hearth made of copper or silver.

A particular method for producing metallic glass rods from the alloy ingots involves re-melting the alloy ingots in quartz tubes having 0.5 mm thick walls in a furnace at 1100° C. or higher, and in some embodiments, ranging from 1150° C. to 1400° C., under high purity argon, and subsequently rapidly quenching in a room-temperature water bath. Alternatively, the bath could be ice water or oil. Metallic glass articles can be alternatively formed by injecting or pouring the molten alloy into a metal mold. The mold can be made of copper, brass, or steel, among other materials.

Optionally, prior to producing an amorphous article, the alloyed ingots may be fluxed with a reducing agent by re-melting the ingots in a quartz tube under inert atmosphere, bringing the alloy melt in contact with the molten reducing agent, and allowing the two melts to interact for at least 500 s at a temperature of at least 1150° C. under inert atmosphere and subsequently water quenching.

Test Methodology for Assessing Glass Forming Ability

The glass forming ability of each alloy was assessed by determining the maximum rod diameter in which the amorphous phase of the alloy (i.e. the metallic glass phase) could be formed when processed by the quartz-tube water-quenching method described above. X-ray diffraction with Cu—Kα radiation was performed to verify the amorphous structure of the alloys.

Test Methodology for Differential Scanning Calorimetry

Differential scanning calorimetry was performed on sample metallic glasses at a scan rate of 20 K/min to determine the glass-transition, crystallization, solidus, and liquidus temperatures of sample metallic glasses.

Test Methodology for Measuring Notch Toughness

The notch toughness of sample metallic glasses was performed on 3-mm diameter rods. The rods were notched using a wire saw with a root radius ranging from 0.10 to 0.13 mm to a depth of approximately half the rod diameter. The notched specimens were tested on a 3-point beam configuration with span of 12.7 mm, and with the notched side carefully aligned and facing the opposite side of the center loading point. The critical fracture load was measured by applying a monotonically increasing load at constant cross-head speed of 0.001 mm/s using a screw-driven testing frame. At least three tests were performed, and the variance between tests is included in the notch toughness plots. The stress intensity factor for the geometrical configuration employed here was evaluated using the analysis by Murakimi (Y. Murakami, Stress Intensity Factors Handbook, Vol. 2, Oxford: Pergamon Press, p. 666 (1987)).

Test Methodology for Measuring Compressive Yield Strength

Compression testing of sample metallic glasses was performed on cylindrical specimens 3 mm in diameter and 6 mm in length. A monotonically increasing load was applied at a constant cross-head speed of 0.001 mm/s using a screw-driven testing frame. The strain was measured using a linear variable differential transformer. The compressive yield strength was estimated using the 0.2% proof stress criterion.

Test Methodology for Measuring Hardness

The Vickers hardness (HV0.5) of sample metallic glasses was measured using a Vickers microhardness tester. Eight tests were performed where micro-indentions were inserted on a flat and polished cross section of a 3 mm metallic glass rod using a load of 500 g and a duel time of 10 s.

Test Methodology for Measuring Density and Moduli

The shear and longitudinal wave speeds of were measured ultrasonically on a cylindrical metallic glass specimen 3 mm in diameter and about 3 mm in length using a pulse-echo overlap set-up with 25 MHz piezoelectric transducers. The density was measured by the Archimedes method, as given in the American Society for Testing and Materials standard C693-93. Using the density and elastic constant values, the shear modulus, bulk modulus, Young's modulus, and Poisson's ratio were estimated.

Test Methodology for Measuring Corrosion Resistance

The corrosion resistance of sample metallic glasses was evaluated by immersion tests in hydrochloric acid (HCl). A rod of metallic glass sample with initial diameter of 2.93 mm and a length of 14.61 mm was immersed in a bath of 6M HCl at room temperature. The density of the metallic glass rod was measured using the Archimedes method. The corrosion depth at various stages during the immersion was estimated by measuring the mass change with an accuracy of ±0.01 mg. The corrosion rate was estimated assuming linear kinetics.

The disclosed Ni—Cr—Ta—P—B and Ni—Cr—Ta—P—B—Si alloys with controlled ranges along the compositional ridge demonstrate bulk glass forming ability. The disclosed alloys are capable of forming bulk metallic glass rods of diameters at least 3 mm and up to about 7 mm or greater when processed by the particular method described herein. Certain alloys with very good glass forming ability also have relatively high toughness exceeding 40 MPa $m^{1/2}$. In particular, alloys can form metallic glass rods of about 7 mm, and the metallic glass can have a notch toughness as high as about 80 MPa $m^{1/2}$. The combination of high glass forming ability along with excellent mechanical and corrosion performance makes the disclosed Ni—Cr—Ta—P—B and Ni—Cr—Ta—P—B—Si metallic glasses excellent candidates for various engineering applications. Among many applications, the disclosed metallic glasses may be used in consumer electronics, dental and medical implants and instruments, luxury goods, and sporting goods applications.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. An alloy comprising at least Ni, Cr, Ta, P, and B, wherein the atomic percent a of Cr is between 3 and 11, the atomic percent b of Ta is between 1.75 and 4, the atomic percent c of P is between 14 and 17.5, the atomic percent d of B is between 2.5 and 5, and the balance is Ni, and wherein the alloy is capable of forming a metallic glass having a critical rod diameter of at least 3 mm.

2. The alloy of claim 1, wherein b is determined by x+y·a, and wherein x is between 1.5 and 2 and y is between 0.1 and 0.15.

3. The alloy of claim 2, wherein x is between 1.85 and 1.9, y is between 0.12 and 0.13, and wherein the alloy is capable of forming a metallic glass having a critical rod diameter of at least 5 mm.

4. The alloy of claim 1 wherein a is between 6 and 8, b is between 2.5 and 3, and wherein the alloy is capable of forming a metallic glass having a critical rod diameter of at least 5 mm.

5. The alloy of claim 1, wherein a is between 8 and 10.5, b is between 2.75 and 3.25, and wherein the alloy is capable of forming a metallic glass having a critical rod diameter of at least 5 mm.

6. The alloy of claim 1, wherein a+b is less than 10, and wherein the alloy is capable of forming a metallic glass having a critical rod diameter of at least 5 mm.

7. The alloy of claim 1, wherein c is between 16 and 17, and wherein the alloy is capable of forming a metallic glass having a critical rod diameter of at least 5 mm.

8. The alloy of claim 1, wherein d is between 3 and 4, and wherein the alloy is capable of forming a metallic glass having a critical rod diameter of at least 5 mm.

9. The alloy of claim 1, wherein up to 1 atomic percent of P is substituted by Si.

10. The alloy of claim 1, wherein up to 2 atomic percent of Cr is substituted by Fe, Co, Mn, W, Mo, Ru, Re, Cu, Pd, Pt, or combinations thereof.

11. The alloy of claim 1, wherein up to 10 atomic percent of Ni is substituted by Fe, Co, Cu, Pd, Pt, or combinations thereof.

12. The alloy of claim 1, wherein up to 1 atomic percent of Ta is substituted by Nb, V, or combinations thereof.

13. The alloy of claim 12, wherein x is between 1.85 and 1.9, y is between 0.12 and 0.13, and wherein the alloy is capable of forming a metallic glass having a critical rod diameter of at least 5 mm.

14. The alloy of claim 1, wherein the alloy comprises $Ni_{80.5-a-b}Cr_aTa_bP_{16.25}B_{3.25}$, wherein the atomic percent a is between 3 and 11, b is determined by x+y·a, wherein x is between 1.5 and 2, y is between 0.1 and 0.15, and wherein the alloy is capable of forming a metallic glass having a critical rod diameter of at least 3 mm.

15. A metallic glass comprising any of the alloys of claim 1.

16. The metallic glass of claim 15, wherein the stress intensity factor at crack initiation of the metallic glass when measured on a 3 mm diameter rod containing a notch with length between 1 and 2 mm and root radius between 0.1 and 0.15 mm is at least 40 MPa $m^{1/2}$.

17. The metallic glass of claim 15, wherein a wire made of the metallic glass having a diameter of 1 mm can undergo macroscopic plastic deformation under bending load without fracturing catastrophically.

18. An alloy comprising a composition selected from the group consisting of $Ni_{68.5}Cr_9Ta_3P_{16.5}B_3$, $Ni_{68.5}Cr_9Ta_3P_{16.25}B_{3.25}$, $Ni_{68.5}Cr_9Ta_3P_6B_{3.5}$, $Ni_{69.5}Cr_8Ta_3P_{6.25}B_{3.25}$, $Ni_{67.5}Cr_{10}Ta_3P_{16.25}B_{3.25}$, $Ni_{68.08}Cr_{8.94}Ta_{2.98}P_{16.67}B_{3.33}$, $Ni_{71.31}Cr_{6.5}Ta_{2.69}P_{16.25}B_{3.25}$, $Ni_{70.75}Cr_7Ta_{2.75}P_{16.25}B_{3.25}$, $Ni_{70.19}Cr_{7.5}Ta_{2.81}P_{16.25}B_{3.25}$, $Ni_{67.94}Cr_{9.5}Ta_{3.06}P_{16.25}B_{3.25}$, $Ni_{70.25}Cr_7Ta_{3.25}P_{16.25}B_{3.25}$, $Ni_{71}Cr_7Ta_{2.5}P_{16.25}B_{3.25}$, $Ni_{69.75}Cr_8Ta_{2.75}P_{16.25}B_{3.25}$, $Ni_{68.5}Cr_9Ta_3P_{15.75}B_{3.25}Si_{0.5}$, and $Ni_{68.5}Cr_9Ta_3P_{15.25}B_{3.25}Si_1$, wherein the alloy is capable of forming a metallic glass having a critical rod diameter of at least 3 mm.

19. A method for processing an alloy to form a metallic glass, the method comprising:

melting an alloy comprising at least Ni, Cr, Ta, P, and B with a formula $Ni_{(100-a-b-c-d)}Cr_aTa_bP_cB_d$ wherein an atomic percent a is between 3 and 11, an atomic percent b is between 1.75 and 4, an atomic percent c is between 14 and 17.5, an atomic percent d is between 2.5 and 5, and the balance is nickel (Ni), into a molten state; and quenching the molten alloy at a cooling rate sufficiently rapid to prevent crystallization of the alloy to form the metallic glass, wherein the alloy is capable of forming a metallic glass having a critical rod diameter of at least 3 mm.

20. The method of claim 19, wherein the temperature of the melt prior to quenching is at least 100° C. above the liquidus temperature of the alloy.

* * * * *